US006419655B1

(12) United States Patent
Nett et al.

(10) Patent No.: US 6,419,655 B1
(45) Date of Patent: Jul. 16, 2002

(54) METHOD FOR CONTROLLING ANIMAL POPULATIONS UTILIZING A STERILANT PROJECTILE

(75) Inventors: Torrance M. Nett, Ft. Collins; Leonard Michael Glode, Golden, both of CO (US)

(73) Assignee: Gonex, Inc., Boulder, CO (US)

( * ) Notice: Subject to any disclaimer, the term of this patent is extended or adjusted under 35 U.S.C. 154(b) by 0 days.

(21) Appl. No.: 09/354,295

(22) Filed: Jul. 15, 1999

Related U.S. Application Data

(60) Provisional application No. 60/093,087, filed on Jul. 16, 1998.

(51) Int. Cl.[7] ..... A61M 31/00; A61F 13/00

(52) U.S. Cl. ..... 604/57; 424/422

(58) Field of Search ..... 119/650; 604/57–64; 424/422, 423, 426

(56) References Cited

U.S. PATENT DOCUMENTS

| | | | | | |
|---|---|---|---|---|---|
| 3,774,607 | A | * | 11/1973 | Schmitz | 128/217 |
| 3,982,536 | A | * | 9/1976 | Krogseng et al. | 128/260 |
| 4,223,674 | A | * | 9/1980 | Fluent et al. | 128/217 |
| 4,450,150 | A | * | 5/1984 | Sidman | 424/1.1 |
| 4,652,550 | A | | 3/1987 | Rivier et al. | 530/313 |
| 4,713,366 | A | | 12/1987 | Stevens | 930/110 |
| 5,169,933 | A | | 12/1992 | Anderson et al. | 530/313 |
| 5,378,688 | A | | 1/1995 | Nett et al. | 514/15 |
| 5,466,587 | A | * | 11/1995 | Fitzpatrick-McElligott et al. | 435/172.1 |
| 5,488,036 | A | * | 1/1996 | Nett et al. | 514/15 |
| 5,492,893 | A | * | 2/1996 | Nett et al. | 514/15 |
| 5,631,229 | A | | 5/1997 | Nett et al. | 514/15 |
| 5,665,363 | A | | 9/1997 | Hansen et al. | 424/211.1 |
| 5,707,964 | A | * | 1/1998 | Nett et al. | 514/15 |
| 5,786,457 | A | | 7/1998 | Nett et al. | 530/402 |
| 6,103,881 | A | * | 8/2000 | Nett et al. | 530/402 |
| 6,214,969 | B1 | | 4/2001 | Janaky et al. | 530/313 |
| 6,326,467 | B1 | * | 12/2001 | Nett et al. | 530/328 |

FOREIGN PATENT DOCUMENTS

| | | |
|---|---|---|
| EP | 0450461 A2 | 10/1991 |
| GB | 2185486 A | 7/1987 |
| WO | WO 90/09799 | 9/1990 |

OTHER PUBLICATIONS

Ballistivet Vaccine Delivery System Advertisement—2 pages.
Ballistivet Vaccine Delivery System Advertisement –2 pages.
Szepeshzi et al., Anti–Cancer Drugs, 3 109–116 (1992).
Proc, Nat'l, Acad. Sci, Bajusz et al., vol. 86, pp. 6318–6322, (Aug. 1989).
Peptides, Proceedings of the Sixth American Pept. Symposium, E. Gross and J. Heienhofer (eds.), pp. 803–806.
U.S. Patent Application No. 07/314,653, filed Feb. 23, 1989.

* cited by examiner

*Primary Examiner*—Sharon Kennedy
(74) *Attorney, Agent, or Firm*—Sheridan Ross P.C.

(57) ABSTRACT

A method and device for regulating the population of animals is directed to the use of a sterilant projectile which permanently or temporarily sterilizes an animal.

6 Claims, 2 Drawing Sheets

METHOD FOR CONTROLLING ANIMAL POPULATIONS UTILIZING A STERILANT PROJECTILE

RELATED APPLICATION

This application claims priority from U.S. Provisional Patent Application No. 60/093,087 filed on Jul. 16, 1998 and from abandoned U.S. Pat. Application Ser. No. 07/314,653, filed Feb. 23, 1989 and related issued U.S. Pat. Nos. 5,378,688; 5,631,229; 5,707,964; 5,492,893; 5,488,036; 5,786,457; 6,103,881 and 6,326,467. The entire disclosure of the above applications and registrations are considered to be part of the disclosure of the accompanying application and are hereby incorporated by reference.

FIELD OF THE INVENTION

The present invention relates to a method and device for regulating the population of animals, and in particular, is directed to a system using a sterilant projectile which permanently and/or temporarily sterilizes an animal.

BACKGROUND OF THE INVENTION

Overpopulation of feral animals such as wild horses, burros, deer and elk in North America, as well as several African species world-wide, has become a problem of great significance. Many herds now share environmental space with human populations, making harvest of such animals for meat using high-powered weapons dangerous. Further, human populations have reduced or eliminated natural predators in their attempts to protect domestic livestock which share the same ecosystems.

Deer may be one of the most valued and viewed mammalian wildlife species in North America. Millions of outdoor visitors savor the sights of deer and try to capture them on film. State fish and game agencies regard deer as a renewable, harvestable resource for viewing and hunting. Sport hunters annually bag about 1 million mule deer and 2 million white-tailed deer. However, deer may cause profound damage by browsing on garden vegetables, flowers, ornamental bushes, and crops. Collisions of automobiles with deer in some areas of the country have increased to alarming levels. In some national parks, deer are a natural resource that may have to be managed. About 50 units in the National Park System in the eastern United States and in the Midwest have identified possible or potential conflicts between the management goals and objectives of parks and white-tailed deer. Various parks with large populations of elk and burros, as well as federal lands which support feral horse populations, have similarly experienced animal management difficulties.

Since the late 1950s, densities of white-tailed deer in many areas of the eastern United States have increased to previously unattained levels and the distribution across the former range has changed drastically. The causes of the changes are various. For example, continuing fragmentation of forested lands into agricultural, suburban, and other types of anthropogenic lands creates favorable habitats with year-round reliable food sources. This increase in food supply has been accompanied by a decrease in historical controls of deer populations. Animals like wolves, coyotes, mountain lions, and bobcats that prey on deer usually do not survive urbanization and have been extirpated in many areas. Restrictions on hunting seasons, bag limits, and available lands for public hunting have also been cited as factors.

Beyond the park service, countless communities face increasing problems with deer overpopulation. Typically, such problems engender inflammatory debate between animal lovers, wildlife or ecology management groups, and hunters. Moreover, there are relatively few options to control deer overpopulation available in urban areas. The park service document lists the following available methods:

1. Live Removal and Relocation for the reduction of large populations are usually not desirable because of the high cost, lack of acceptable release sites, and high mortality of the relocated animals.

2. Removal by Public Hunting can be done only in units where it is specifically authorized by the U.S. Congress. Only in these few units may hunting by the public be used to control the density of deer. Hunting in urban areas, even with muzzle loaded or other shotguns or by bow and arrow is impractical for safety reasons.

3. Direct Reduction by Shooting by National Park Service personnel can be done under provisions of the National Park Service Organic Act and the National Park Service Management policies. It is the least desirable alternative.

4. Fertility Control (Contraception) reduces birthrates but does not reduce the sizes of existing populations. It must therefore be implemented before the populations surpass established acceptable levels. If a population reaches an excessive size, fertility control may be implemented but must be accompanied by a reduction of the population size by other means.

5. Fencing may be used to protect threatened and endangered plants from browsing by deer, to prevent deer from crossing roadways, and to minimize the effects of deer on woodlots, agricultural areas, and developed areas. Fencing for the mitigation of harm from deer is limited to small areas because fences can prevent desired migration or dispersal of other animal species. Furthermore, the construction and maintenance of fences is labor intensive and expensive, and fences may be an unacceptable intrusion into the cultural aesthetic values of some parks.

6. Landscape-Agriculture-Timber Management can be designed to create less than favorable habitats for deer with unpalatable plant species, wide open spaces, or severely thinned forest habitats. Such management may, however, be too costly or conflict with the mandated objectives of a park or overall management of adjacent areas.

7. Repellents are compounds or substances that are sprayed on or attached to vegetation to repel browsing by species such as deer. No single repellent is effective for a wide range of plants and conditions. Research revealed that the efficacy of repellents is low and that repellents at best are an interim solution under limited circumstances. Therefore, there exists a long felt and unsolved need to provide methods for controlling over populations of feral animals which are practical, cost effective, socially acceptable and are capable of being administered by governments while maintaining hunting recreation to accomplish agency objectives.

SUMMARY OF THE INVENTION

To deal with the problems as set forth above, the present inventors have devised an alternative form of sterilization which can be modified to either temporarily or permanently (depending on the desired result) sterilize an animal. The fertility of all mammals, including man, is controlled by a single hormone, Gonadotropin Releasing Hormone (GnRH) which is produced by the hypothalamus and secreted in a pulsatile fashion. Paradoxically, continuous administration of the hormone leads to pituitary desensitization and a resultant decrease in the gonadotropins FSH and LH which are crucial to control of both ovulation and spermatogenesis in females and males respectively. Potent agonists and antagonists of the GnRH decapeptide are available and have been successfully used in human biology to control prostate cancer, breast cancer, and to treat infertility, endometriosis, and precocious puberty.

For wild animals, this approach has several potential advantages over other methods of contraception. These include:

1) a single treatment should permanently or temporarily sterilize an animal;
2) the same treatment should be effective in both males and females and in different mammalian species;
3) GnRH agonist or GnRH-toxin conjugates is metabolized from the body within a few days of treatment;
4) The proteinaceous nature of GnRH agonist and by GnRH-toxin conjugates eliminates the possibility of passage through the food chain to humans or other non-target species;
5) The small volume required for effective contraception facilitates microencapsulation and administration by diodegradable projectiles.
6) Protein conjugates of GnRH can induce autoimmunity to GnRH adding to the sterilizing short and long term potential.

One agent of the present invention relates to a new weapon/biology system that can be used worldwide in controlling animal populations which overpopulate habitats occupied by humans while avoiding the necessity of killing animals. Moreover, the system of the present invention may give rise to an entirely new sport, similar to "catch and release" fishing, which could enhance or complement the hunting experience in areas where more traditional methods of harvesting game animals are not feasible.

DETAILED DESCRIPTION OF THE PREFERRED EMBODIMENT

Figure 3:
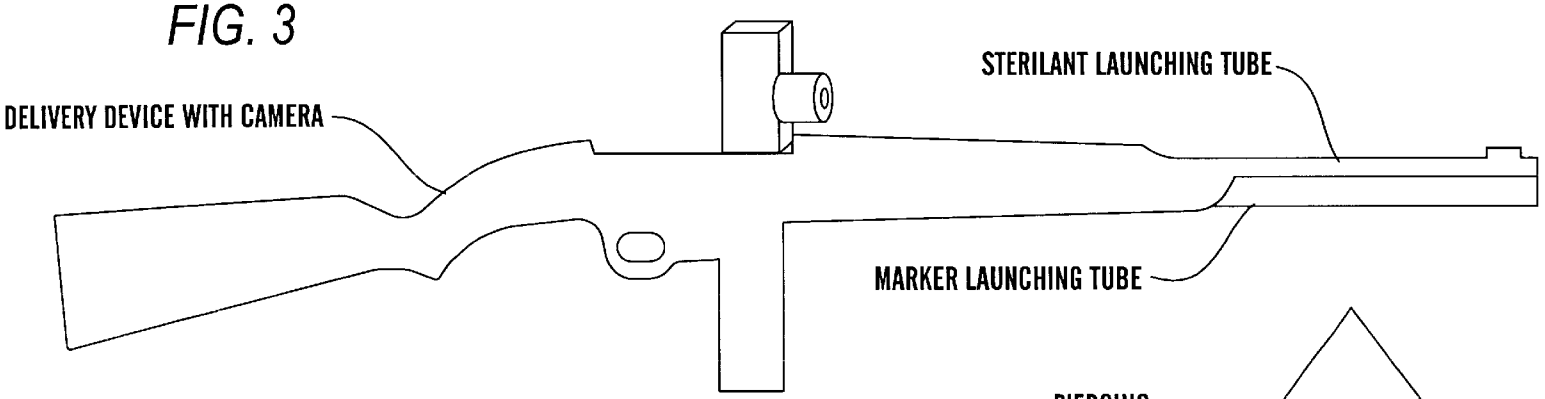
FIG. 3 shows a delivery device of the present invention.
Figure 2:
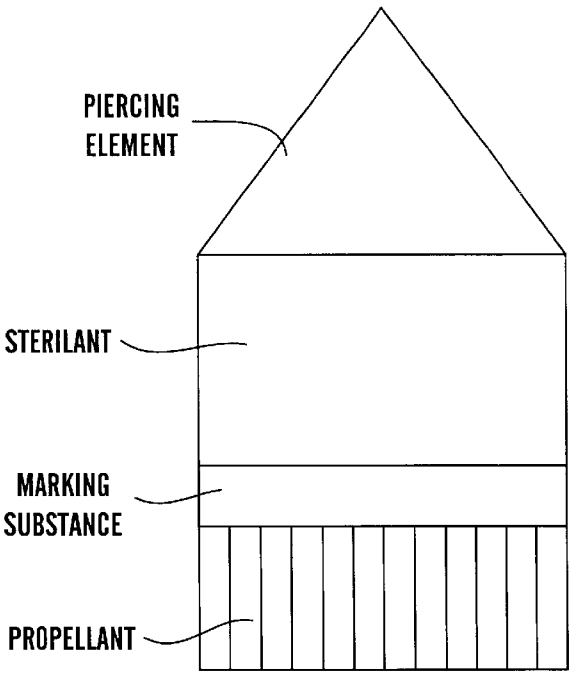
FIG. 2 is a side view of the ballistic projectile shown in FIG. 1.

The present invention is directed to a system designed to control feral animal populations, while at the same time preserving the sport of hunting, and recognizing the legitimate concerns of animal welfare activists to control population growth in a humane way. The present system consists of delivery of a temporary or permanent sterilizing biochemical compound using weaponry devices and projectiles. In preferred embodiments, the system provides for convenient marking and documentation of animals which have been permanently or temporarily sterilized.

The components of one embodiment of the system are as follows:

Biochemical Sterilant: This may consist of any of the biochemical agents known to inhibit the hypothalamic-pituitary-gonadal axis. Preferred formulations include GnRH agonists and antagonists, GnRH-toxin conjugates, and depot formulations of sex steroids such as estrogens, progestins, and androgens.

Projectile: The projectile may be any device which allows for instantaneous or sustained release of the biochemical sterilant and which can be formulated into an appropriate projectile delivery system. Preferred embodiments include the use of polyglycolic acid polymers and liposomal or lipid foam delivery systems. Sustained mechanical delivery systems employing osmotic pump devices can be used for accomplishing this purpose.

Marker: A marker system which allows sterilized animals to be easily identified is a component of the system. Such markers include chemical dyes released by the projectile upon impact with the animal's skin, an electronic signal emission device, and a mechanical tag which can be identified by any of a number of techniques including but not limited to visual, ultrasound, laser, or infrared inquiry. The marker may be delivered simultaneously via a separate projectile.

Weapon system: One aspect of the present invention relates to a device to propel the projectile(s) to deliver the sterilant at a distance. Such a device includes a stringed bow, elastic powered launching platform, or a more traditional firearm utilizing gas expansion in a barrel to accelerate the projectile and marking device toward the animal. A preferred embodiment includes automated force control coupled with an aiming device such that the velocity of the projectile is regulated at a distance as it hits the animal, preferably resulting in uniform penetration into the flesh prior to instantaneous or sustained release of the sterilant.

Documentation System: A photographic, electronic, or other record of the animal sterilized may be captured at the time of projectile firing or impact by inclusion of appropriate electronic or photographic apparatus in the aiming device of the weapon. A preferred embodiment would include a digital image capture system built into a telescopic rifle sight which would record the view of the operator at the time the weapon was fired and the marking of the animal at the time of projectile impact.

Although the present invention includes any projectile capable of delivering an effective dose of a medicant to an animal, preferred methods of delivery include guns specifically designed to deliver such medicants, and/or bow and arrow systems. Preferably, a device for delivery of effective doses to an animal includes a firearm-type device, similar to existing firearms and tranquilizing guns. While it is within the scope of the present invention that syringe-type projectiles can be used, in a preferred embodiment, ballistic projectiles containing desired amounts and types of medicants are used, preferably in a biodegradable form. Indeed, appropriate ballistic projectiles can include those disclosed in U.S. Pat. Nos. 3,948,263; 3,982,536; 4,449,982; 4,664,664 and 4,326,524, incorporated herein by this reference.

In one particular preferred embodiment, the projectile contains an effective amount of a sterilant to cause either permanent or temporary sterilization of an animal. The type of sterilant used will depend upon the animal to be treated, and one of skill in the art will understand and appreciate the variances in administration, dose, repeated administration, etc., based on the guidance provided herein and the type of animal to be treated. Effective sterilants for use in the present invention include suitable steroids, hormones (both natural and artificial) as well as hormone conjugates such as GnRH-toxin conjugates. Suitable GnRH toxin conjugates for use in the present invention are disclosed in U.S. Pat. Nos. 5,707,964; 5,631,229, and 5,378,688, such patents incorporated herein by this reference. In a most preferred embodiment, D-leu$^{6}$-desGly$^{10}$-Puo-Ethylamide is used as the sterilization agent.

Appropriate ballistic projectiles for use in the present invention can be formulated so that effective amounts of sterilants are delivered to an animal after the animal is hit. Thus, immediate and slow-release technologies currently available can be used to formulate effective compositions, and such formulations can be in a liquid, semi-liquid, or solid form for inclusion into a ballistic projectile. The ballistic projectile should be capable of piercing an animal's hide so that the effective composition can be absorbed by the animal's body, for example, through intra-muscular or subcutaneous absorption. Suitable ballistic projectiles to accomplish the effective piercing of an animal's hide are known. While liquid active materials can be delivered by projectile syringes, the use of many sterilants require reconstitution prior to use of the active material. As such, a preferred embodiment of the present invention includes polymer associated, powdered, or other dry forms of medicant and/or sterilant.

As will be appreciated, although the present invention is principally directed to delivering a sterilant to a wild animal population, other medicants can be similarly delivered using the present system, either alone or in conjunction with sterilants. For example, deer populations may be deficient in certain minerals or vitamins, or require treatment for a particular disease. Suitable medications can therefore be delivered using the present system. In a particular embodiment, such other medicants are combined with a desired sterilant to not only treat animals having certain maladies, but further temporarily or permanently sterilizing such animals to achieve the wild animal population control objectives as described above.

Another aspect of the present invention relates to a method and device for hunting wild animals that does not have as its goal the killing of such animals, but rather the treatment and/or inoculation and/or sterilization of the animals. Indeed, one aspect of the present invention is analogous to "catch and release" fishing, wherein a hunter will hunt animals for one of the following purposes:

1. To deliver to particular animals an effective dose of a medicant or sterilant;
2. To identify particular animals through use of marking projectiles, ether paintball markings, fluorescent markings, tags of other identifying markers, etc.; and
3. To document a photographically recorded "kill" by the hunter through photographic, electronic or other recording means.

One or more of the above-referenced purposes can be employed in the present invention. Indeed, in a preferred embodiment, hunters seek out desired animals, shoot the animals with a projectile of the present invention to deliver a sterilant and/or medicant, such projectile further containing a marker such as a dye (either biodegradable or not) which marks the animal, and wherein the gun used to shoot the animal is provided with an apparatus for recording the image of the animal. In such a manner, not only is the goal of controlling wild animal populations achieved, the hunter is rewarded with a photographic image or "trophy" of the animal which has been permanently or temporarily sterilized through administration of the sterilant. Wildlife biologists can use the markings left on the animals, alone or in combination with the photographic evidence, to keep track of particular animals, herds, etc. that have been effectively treated with a medicant and/or sterilant. The hunter is also able to hang an enlarged picture of his "trophy" on a wall rather than the conventional head and antlers of a deceased animal. In this manner, it is believed that the present invention opens up an entirely new aspect of hunting whereby the goal is not to kill animals, but rather to assist in effective wildlife management and to provide an alternative form of hunting recreation which does not involving killing the quarry. It is believed that the population of hunters will greatly increase in view of the present invention, since a significant percentage of the population declines to hunt wild animals, even if for legitimate population control purposes.

A representative list of medicants that can be used in the practice of the invention include: vaccines (rabies, disteapa, brucellosis, etc.); antibiotics; antivirals, hormones, pheromones, nucleic acids (including antisense, genes, ribozymes, viruses, viral vectors, retroviruses, or retro viral vectors) or cytokines, angiosenic agents, growth enhancing peptides, growth suppressing proteins or peptides.

The ballistic pellets of the present invention preferably comprise an effective amount of a material of from about 40% to 97% by weight of such material, more preferably between about 50% to 85% by weight, and most preferably between about 60% to 75% by weight. As will be clear to one of skill in the art, a powder blend of any appropriate effective material can be pelletized on a conventional pelletizing machine to produce the ballistic pellet of the present invention and various excipients and lubricants (e.g. magnesium stearate, calcium stearate, sodium steryl fumarate, stearic acid, sodium lauryl sulfonate, polyoxyethylene, polyethyleneglycols, glycerol behenate, hydrogenated vegetable oils and mixtures thereof) can be used to facilitate the release of active ingredients from the ballistic pellets. Ballistic pellets preferably comprise from about 0.2 to about 5% by weight of a lubricant and from about 2% to about 40%, preferably 3% to 20%, and most preferably between about 4% and 10% of an excipient. Additional excipients can be used to increase strength, control solution times, improve powder handling, and efficacy of a particular product, such excipients including fumed silicas, sodium starch glycolates, calcium phosphates, calcium carbonate, dextrins, polyvinylpyrrolidone, hydroxyprophylcellulose, hydroxyprophylmethylcellulose, polylactic acid, polyglycolic acid, magnesium aluminum silicates, microcrystallinecellulose, sodium carboxymethylcellulose, and mixtures thereof.

The shape of pellets of the present invention can be formed into any possible shape that a pelletizing machine is capable of making, preferably the shape and size of the pellet is suitable for implanting into an animal by use of a gun. As such, in a preferred embodiment, the ballistic pellet of the present invention is shaped in a manner similar to a conventional bullet, having a sharp top and capable of passing through the hide of an animal into muscle tissue. The size of the ballistic pellet of the present invention can vary depending upon dose to be administered to any particular animal and compatibility with the weapon used to fire the ballistic pellet.

The present invention is preferably directed to administration of desired medicants or sterilants to wild or feral animals rather than domestic animals and thus preferred animals to which the present invention is directed include deer, elk, burros, wild horses, rabbits, geese, bear, mountain lion, wolves, bison, goats, mountain sheep, moose, seals, otters, elephants, antelope, rhinos, lions, tigers, water buffalo, giraffe, and the vast variety of wild animals, especially those found on the African continent.

The ballistic pellet of the present invention is administered using a weapon so that the pellet enters into any area of the animal which allows the pellet to come into contact with tissue fluids, preferably intramuscularly, and most preferably in the shoulder or hind quarter of any particular animal.

As can be appreciated, given that the present invention is directed to the administration of ballistic pellets to wild animals, a hunter will need to approach such wild animals in their native habitat, thus requiring the ballistic pellet to travel typically at least 50 yards and more likely over 100 yards to reach the target animal. Thus, the ballistic pellet must be configured to withstand the forces of the weapon used to project such pellet over such relatively long distances and the pellet must be of a design so that impact of the pellet with the animal enables the active ingredient thereof (medicant, sterilant, etc.) to pass through the animal's hide and to be absorbed by the animal's tissues. Studies with captive mule deer demonstrate the effectiveness of remotely delivering contraceptives via biodegradable implants compared to hand syringe injections.

As will occur to those of skill in the art, any acceptable photographic device can be used in conjunction with the delivery device (e.g. gun) used to project the ballistic pellet, preferably a zoom lens camera of a suitable size that facilitates mounting on a gun. For example, a miniature camera used in conjunction with existing gun scopes can be used to record the animal to be targeted before, during and after the moment of impact of the ballistic pellet with such animal. Indeed, videotaped recordings of the entire hunting event can be achieved using various known means, including digital recording medium.

The following examples and test results are provided for purposes of illustration and are not intended to limit the scope of the present invention.

EXAMPLE 1

Effect of a Depot of D-leu$^{6}$, des-Gly$^{10}$-Pro-$^{9}$-ethylamide GnRH (Lupron, Leuprolide_on mature male and Female Deer Lupron™ depot injection (3 mo/21 mg) purchased from TAP pharmaceuticals is resuspended as recommended for human use, and injected IM into the flank of 3 does and 3 bucks at a dose of 0.1, 0.2, or 0.3 mg/Kg. The 0.1 mg/kg dose is believed to be successful in complete suppression of Human LH and FSH production in trials designed to treat metastatic prostate cancer.

Each animal treated with the depot leuprolide is bled weekly for 4 weeks, then monthly and LH, ESH, Testosterone, and Estrogen is measured in the peripheral blood. If the lowest dose is found to be equally effective with the highest, a second group of animals is similarly treated with 0.1, 0.06, and 0.03 mg/Kg to determine the minimal effective dose of depot leuprolide necessary to suppress LH and FSH for 3 months.

EXAMPLE 2

Figure 4:
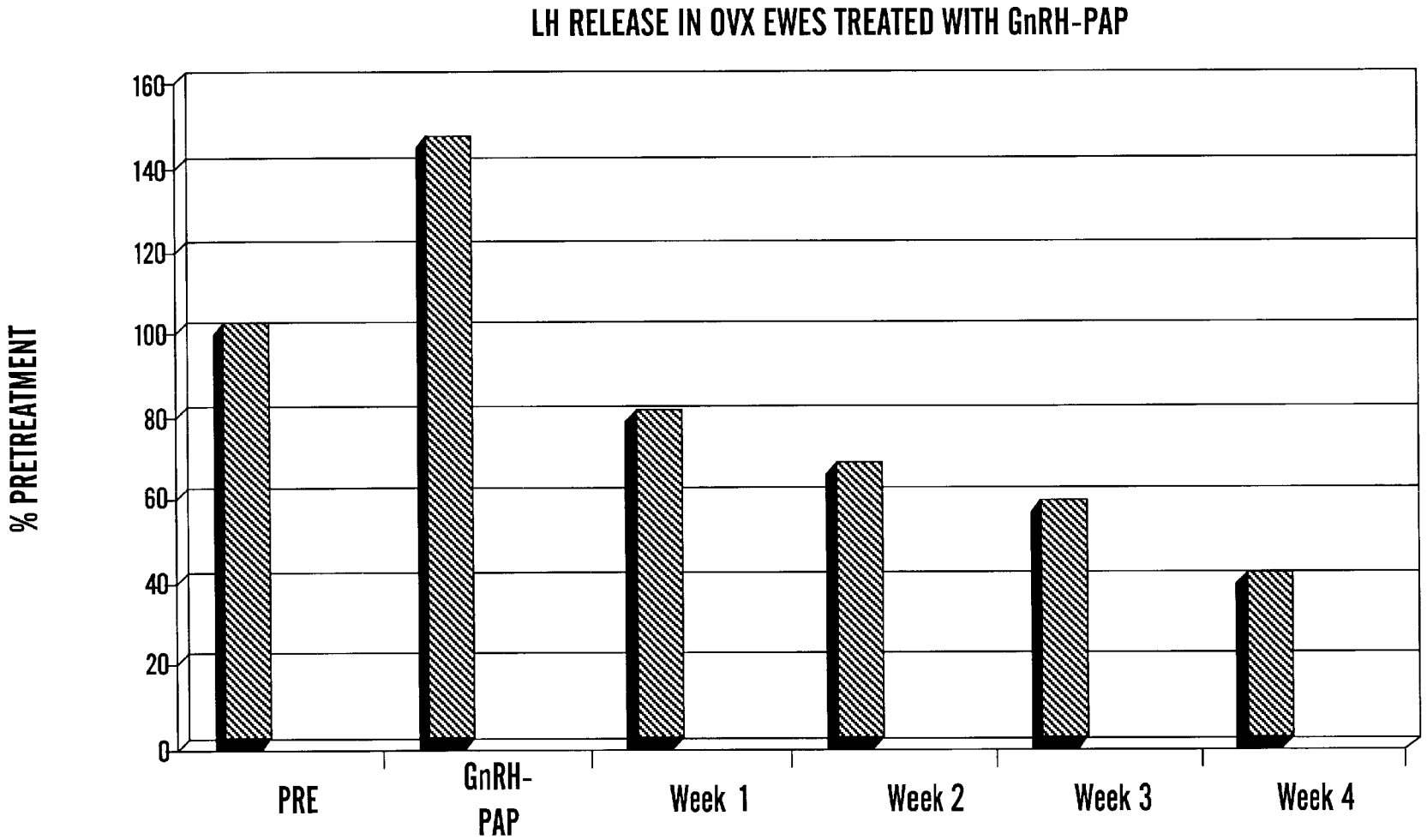
FIG. 4 shows LH release ,i.e., OVX Ewes and noted with GnRH-PAP.

Effect of D-lys$^{6}$GnRH-pokeweed Antiviral Toxin Conjugate on Deer Following IM Injection FIG. 4 shows the efficacy of GnRH toxin conjugates in suppressing LH in ovariectomized ewes. It is apparent that a single dose can inhibit subsequent LH release from the pituitary by a standard challenge dose of normal GnRH.

Three does and three bucks are treated with 0.01, 0.03 or 0.1 mg/Kg GnRH-PAP conjugate. As with the above experiment, animals are bled weekly for four weeks, then monthly for the remainder of the year to determine the effects of the conjugate on the reproductive hormones listed above. These data are compared with the leuprolide data above, which acts as a positive control, in that the animals as treated are expected to recover reproductive potential within the year. Note that the does in both aims 1 and 2 are treated in October–November, shortly prior to the anticipated beginning of the natural period of heat or breading season estrus. As a control, untreated animals are also bled at the indicated time to provide normalized information on hormone levels.

EXAMPLE 3

Delivery of Polyglycolic Acid by a Weapon-fired Projectile

Polymers used for sustained delivery are fashioned into a projectile similar to the 0.22 caliber lead bullet used in standard rifles. Polyglycolic acid polymer bullets are fired from a 0.22 caliber rifle into carcass flanks from beef obtained from a local slaughter house. By dissecting the carcass, the range necessary to reproducibly develop 1–2 inches of penetration is determined. A highly sophisticated weapon employing metered gas "escape" from the firing chamber, or metered gas delivery from a nitrogen or $CO_2$ source to the projectile is accomplished by infrared, sonar, laser, or similar range finding electronics such that the velocity of the projectile is controlled and that animals which are "out or range" are not fired upon. A video recording system may also be employed along with a marking system to enhance the sporting experience of shooting the weapon.

EXAMPLE 4

Evaluation of a Remote Delivery System for Administering GnRH-Toxin Conjugates to Captive Mule Deer GnRH-cytotoxin conjugates disrupt reproduction in a variety of mammalian species by binding to and destroying pituitary gonadotrophs; as a result, luteinizing hormone (LH) secretion ceases and ovulation cannot occur (in males, lack of LH suppresses testosterone secretion) (T. M. Nett, unpublished data). Because virtually all pituitary gonadotrophs must he destroyed to effect infertility using this approach, determining the amount of GnRH analog needed to bind and stimulate at least one receptor on each pituitary gonadotroph is prerequisite to estimating an effective GnRH-cytotoxin conjugate dosage in mule deer (Nett et al. 1993, Baker 1994). Experiments to determine a minimum effective GnRH analog dosage that elicits maximum serum LH concentrations (presumably by stimulating virtually all pituitary gonadotrophs) revealed that >2 $\mu$g GnRH analog/50 kg body mass (BM), delivered intravenously (IV), induced equivalent maximum serum LH responses in mule deer does; however, the magnitude of those responses varied widely among individuals and across different reproductive states (Nett et al. 1993, Baker 1994).

Based on these experiments, GnRH-cytotoxin conjugate doses $\geqq$2 $\mu$g/50 kg BM IV should be sufficient to cause infertility in mule deer does. However, the need for IV administration will significantly limit the practicality of using GnRH-cytotoxin conjugates in managing a free-ranging deer population because animals must be captured, handled, and treated individually. Although GnRH analog-induced LH secretion curves are essentially the same regardless of whether analog is delivered IV or intramuscularly (IM), reliance on IM hand injections will place equally severe limits on using GnRH-cytotoxin conjugates in free-ranging settings. It follows that the ability to remotely deliver GnRH-cytotoxin conjugates to wild deer will be necessary before long-term application to population management is practical, and that estimates of effective dosage should anticipate and accommodate potential influences of delivery via projectile syringe or ballistic implant on the pharmacokinetics of GnRH-cytotoxin conjugates. Here, we describe a pilot experiment comparing LH secretion patterns in mule deer does stimulated by GnRH analog delivered intramuscularly via syringe injection and ballistic implant.

METHODS AND MATERIALS

We used captive hand-raised pregnant adult 2.5 yrs old) mule deer does (n=6) in this pilot experiment. All does were housed at the CDOW's Foothills Wildlife Research Facility (FWRF) throughout the study; they resided together in a 7 ha pasture before and between treatment/sampling periods, and were held in pairs in 50 $m^2$ isolation pens during the two 24 hr treatment/sampling periods. Alfalfa hay and a pelleted high-energy supplement was provided as prescribed under established feeding protocols for mule deer throughout the study; fresh water and mineralized salt were provided ad libitum. Health of each doe was evaluated daily throughout the study, and does were weighed immediately prior to each treatment/sampling period.

We compared LH secretion patterns stimulated by GnRH analog delivered intramuscularly via syringe and ballistic implant in a blocked, crossover experiment with a repeated measures structure. Does were randomly assigned to syringe or ballistic implant treatment groups (n=3 does/treatment) for the initial 24 hr treatment/sampling period; we then switched treatment assignments for the second period conducted 6 days later.

For each treatment/sampling period, we sedated does with 40–80 mg xylazine HCL injected IM. Once sedated, each doe was fitted nonsurgically with an indwelling jugular catheter. After all 6 does were catheterized, we collected 5 Ml of blood from each (pretreatment). We then partially reversed sedation by administering 10 mg yohimbine HCL IV. Once standing, the upper hind leg of each doe targeted for ballistic implantation was covered with a transparent, adhesive-backed film. Each doe then received 12 Mg GnRH analog (about 8.5 $\mu$g/50 kg BM), delivered in one of two forms: 1) via 1 Ml of a 12 $\mu$g GnRH analog/Ml solution, injected IM by hand, or 2) via a soluble ballistic implant ("biobullet") carrying 12 Mg GnRH analog and about 100 mg lactose powder, implanted IM using an air-powered delivery system (BallistiVet, Implant System). Analog from a single batch was used in making both solutions and ballistic implants. All does received GnRH in the right hind leg during the first treatment/sampling period and in the left hind leg during the second. Immediately after delivery and periodically thereafter, we examined and palpated ballistic implant entry sites to ensure delivery was achieved and that bleeding or injury at entry sites was not excessive. After all sampling had been completed, we administered $3\times10^6$ U penicillin G benzathine/penicillin G procaine injected subcutaneously, removed catheters, and returned does to their pasture.

In addition to pretreatment (time 0) samples, we collected about 5 ml of blood from each doe at 1.5, 3, 4.5, 6, 7.5, 9, 10.5, 12, 15, 18, 21, and 24 hrs after administering GnRH. All blood samples were held for 6–12 hrs at 4 C, then centrifuged. Serum as collected and stored at −20 C until analyzed. Serum concentrations of LH (ng/Ml) was measured using an ovine LH radioimmunoassay (Niswender et al. 1969) previously validated for use in mule deer.

The following parameters are compared: 1) maximum LH responses (highest LH concentration achieved after treatment, minus pretreatment concentration), 2) time intervals for reaching maximum serum LH concentrations, and 3) total 24 hr LH secretion (estimated by calculating the area under the LH curve) (Abramowitz and Stegun 1968) stimulated by GnRH analog delivered intramuscularly via syringe injection and ballistic implant. Data are analyzed using least squares ANOVA for General Linear Models (Freund et al. 1986) and the SAS Interactive Matrix Language. Responses to treatments are analyzed with two-way factorial analysis of variance for a randomized complete block design with a repeated measures structure. Delivery approaches are used as treatments and individual animals as blocks; factors in the analysis are treatment and time. The animal within treatment variance is used as the error term in testing for treatment effects. Time is treated as a within subject effect using a multivariate approach to repeated measures (Morrison 1976) In addition, we use a priori orthogonal contrasts to test for differences among individuals (Miller 1966).

RESULTS AND DISCUSSION

Results discussed here are preliminary and largely descriptive. Neither ballistic delivery nor hand-injection of GnRH had any apparent acute or chronic effect on health of does used in this pilot study. In general, ballistic implant sites were minimally traumatized and, in 5 of 6 cases, were difficult to detect without extensive examination. Does reacted minimally to being shot with implants and mild, transient (15 sec) lameness was the only observable clinical effect. All implants appeared to penetrate the haircoat and skin and embed >1 cm deep in the semimembranosus or semitendinosus muscles. In one doe (E91), the implant apparently struck the caudal margin of the semitendinosus muscle and passed through the muscle mass, lodging in subcutaneous tissues at the lateral margin of the perineum; otherwise, implants were not seen or palpated. In addition, we observed no residue on the adhesive-backed overlay that might indicate contents had been released from the rear of implants on impact.

Figure 1:
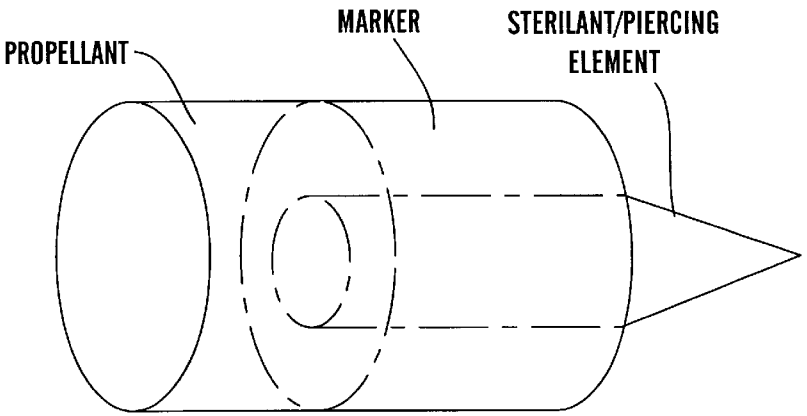
FIG. 1 is an illustration of a ballistic projectile of the present invention showing a piercing element, a sterilant, a marking substance and a propellent.

Serum LH responses stimulated by 12 $\mu$g GnRH delivered via ballistic implants appeared to vary widely among individual does as compared to responses stimulated by the same dose delivered via syringe injection (FIG. 1). In 2 does (D92, W92), we observed no measurable response to implant-delivered GnRH; a delayed and somewhat protracted response was observed in a third doe (E91) whose implant lodged in subcutaneous tissue. For the 3 other does (A91, S90, Y92), LH responses were comparable between delivery systems, although the onsets of their responses to implant-delivered GnRH were delayed about 1.5–6 hrs compared to responses to hand-injected GnRH. In 3 of the 4 does responding to both treatments, maximum serum LH concentrations stimulated by hand-injected GnRH exceeded maximum responses stimulated by implant delivered GnRH by >50%.

While various embodiments of the present invention have been described in detail, it is apparent that modifications and adaptations of those embodiments will occur to those skilled in the art. However, it is to be expressly understood that such modifications and adaptations are within the scope of the present invention, as set forth in the following claims.

What is claimed is:

1. A method for administering a sterilant to a wild animal, comprising:

(a) providing a ballistic projectile containing an effective amount of a sterilant;

(b) providing a weapon capable of receiving said ballistic projectile and of firing said projectile toward said wild animal, said projectile or a companion projectile fired simultaneously therewith, comprising a means for marking said animal such that said animal can be identified as being hit by said projectile, said weapon having a recording means operatively associated therewith to record the image of said animal;

(c) firing said projectile into the muscle tissue of an animal, such sterilant being effective to either permanently or temporarily sterilize the animal.

2. The method of claim 1, wherein said pellet comprises from about 45% to a 97% by weight of said sterilant.

3. A system for providing a sterilant or medicant to wild animals, comprising:

a ballistic projectile containing an effective amount of a sterilant or medicant;

a weapon capable of receiving said ballistic projectile and firing said projectile towards said wild animal;

said weapon having a recording means operatively associated therewith to record the image of said animal; and wherein said projectile or companion projectile fired simultaneously comprises a means for marking said animal such that said animal can be identified as being hit by said projectile.

4. The method as set forth in claim 1 wherein said sterilant is selected from the group consisting of steroids, hormone toxin conjugates, GnRH agonists, and GnRH antagonists.

5. The method as set forth in claim 1 wherein said projectile comprises an agent known to inhibit the hypothalamic-pituitary-gonadal axis.

6. The method as set forth in claim 1 wherein said sterilant comprises a hormone toxin conjugate comprising a peptide hormone capable of selectively binding to cells having GnRH receptors, said conjugate capable of destroying cells expressing said receptors.

* * * * *